US007273029B2

(12) United States Patent
Oda et al.

(10) Patent No.: US 7,273,029 B2
(45) Date of Patent: Sep. 25, 2007

(54) CYLINDER LINER AND CYLINDER BLOCK

(75) Inventors: Teruyuki Oda, Tokyo (JP); Tsuyoshi Nozawa, Tokyo (JP); Kazuo Koyama, Nagano (JP)

(73) Assignees: Fuji Jukogyo Kabushiki Kaisha, Tokyo (JP); Kabushiki Kaisha Koyama, Nagano (JP)

( * ) Notice: Subject to any disclaimer, the term of this patent is extended or adjusted under 35 U.S.C. 154(b) by 86 days.

(21) Appl. No.: 11/330,338

(22) Filed: Jan. 12, 2006

(65) Prior Publication Data

US 2006/0156917 A1 Jul. 20, 2006

(30) Foreign Application Priority Data

Jan. 14, 2005 (JP) ..... 2005-008103

(51) Int. Cl.
*F02F 1/00* (2006.01)

(52) U.S. Cl. ..... 123/193.2

(58) Field of Classification Search .. 123/193.1–193.3, 123/668, 195 R; 29/888.06, 888.061; 92/171.1
See application file for complete search history.

(56) References Cited

U.S. PATENT DOCUMENTS 3,382,858 A * 5/1968 Gallois et al. ..... 123/193.1
3,641,882 A * 2/1972 Hall ..... 92/171.1
4,153,983 A * 5/1979 Stockton ..... 29/888.061
4,505,234 A * 3/1985 Meiners ..... 123/41.84
4,905,642 A * 3/1990 Suzuki et al. ..... 123/195 R
4,936,262 A * 6/1990 Paul et al. ..... 123/25 C
5,562,073 A * 10/1996 Van Bezeij et al. ..... 123/193.2
5,749,331 A * 5/1998 Pettersson et al. ..... 123/193.2
6,123,052 A * 9/2000 Jahn ..... 123/41.79
6,298,818 B1 10/2001 Koyama et al.

FOREIGN PATENT DOCUMENTS

JP 07-139419 5/1995
JP 2001-227403 8/2001
JP 2001-334357 12/2001

* cited by examiner

*Primary Examiner*—Marguerite McMahon
(74) *Attorney, Agent, or Firm*—Smith, Gambrell & Russell LLP

(57) ABSTRACT

A cast iron cylinder liner of the present invention includes a plurality of grooves formed on an outer surface of the cylinder liner. Each of the grooves extends in a circumferential direction of the cylinder liner in a ring or spiral shape, and the grooves divide the outer surface of the cylinder liner into a plurality of ring or spiral sections. The outer surfaces of the ring sections have a uniform distance from the central axis of the cylinder liner over the entire area of the outer surfaces, and the grooves being arranged symmetrically with respect to the center of the cylinder liner in an axial direction thereof. Each of the grooves has a J-shaped longitudinal cross-section including a first inclination part and a groove bottom part. The first inclination part extends from the outer surface of one of the ring sections or of one turn of the spiral sections toward the center of the cylinder liner in an axial direction thereof. The groove bottom part has a longitudinal cross-section approximately in the form of a circular arc, and extends from the first inclination part in a direction away from the center of the cylinder liner in an axial direction thereof.

10 Claims, 16 Drawing Sheets

FIG. 21

Relationship Among Cutting Edge Angle, Pitch and Productivity
(Nose angle: 35° )

| | Pitch P | | | |
|---|---|---|---|---|
| Cutting edge angle α | 1mm | 2mm | 3mm | 4mm |
| 5° | NG | NG | NG | NG |
| 10° | NG | NG | △*2 | △*3 |
| 15° | NG | △*1 | △ | △ |
| 20° | NG | ◎ | ◎ | ◎ |
| 25° | NG | ◎ | ◎ | ◎ |
| 30° | NG | ◎ | ◎ | △ |
| 35° | NG | ◎ | △ | △ |
| 40° | NG | △ | △ | △ |
| 45° | NG | △ | △ | △ |
| 50° | NG | △ | △ | △ |
| 55° | NG | NG | NG | NG |

NG: Undercut was not formed

△: Poor contact at the Interface, Poor productivity, Improper for Mass Product (Small undercut or large ratio of outer surface)

◎: Good contacting state, Good Productivity

*1: Cutting angle of 14° or more was necessary for forming an undercut.

*2: Cutting angle of 9° or more was necessary for forming an undercut.

*3: Cutting angle of 6° or more was necessary for forming an undercut.

FIG. 23

Relationship Among Cutting Edge Angle, Pitch and Productivity
(Nose angle: 55° )

| | Pitch P | | | |
|---|---|---|---|---|
| Cutting edge angle α | 1mm | 2mm | 3mm | 4mm |
| 5° | NG | NG | NG | NG |
| 10° | NG | NG | △*2 | △*3 |
| 15° | NG | △*1 | △ | △ |
| 20° | NG | △ | △ | △ |
| 25° | NG | △ | △ | △ |
| 30° | NG | ◎ | ◎ | △ |
| 35° | NG | ◎ | △ | △ |
| 40° | NG | NG | NG | NG |
| 45° | NG | NG | NG | NG |
| 50° | NG | NG | NG | NG |
| 55° | NG | NG | NG | NG |

NG: Undercut was not formed

△: Poor contact at the Interface, Poor productivity, Improper for Mass Product (Small undercut or large ratio of outer surface)

◎: Good contacting state, Good Productivity

*1: Cutting angle of 14° or more was necessary for forming an undercut.

*2: Cutting angle of 9° or more was necessary for forming an undercut.

*3: Cutting angle of 6° or more was necessary for forming an undercut.

CYLINDER LINER AND CYLINDER BLOCK

CROSS REFERENCE TO RELATED APPLICATIONS AND INCORPORATION BY REFERENCE

This application is based upon and claims the benefit of priority from the prior Japanese Patent Application No. 2005-008103, filed on Jan. 14, 2005; the entire content of which is incorporated herein by reference.

BACKGROUND OF THE INVENTION

1. Field of the Invention

The present invention relates to a cylinder liner and a cylinder block having a cast cylinder liner therein to be used for an engine.

2. Discussion of the Related Art

A widely-used cylinder block for an engine is made of an aluminum alloy for decreasing the weight thereof and achieving low fuel consumption. For producing an engine having a good abrasive resistance, a cast iron cylinder liner is provided on the inner surface of a cylinder block main body.

However, it is possible that, in the production by a conventional cylinder block having a cylinder liner, gaps or voids are formed at the interface between the cylinder block main body and the cylinder liner.

When a gap is formed at the interface between the cylinder block main body and the cylinder liner, the thermal conductivity therebetween is decreased. Accordingly, the cooling process of the engine can be influenced, and the thermal conductivity in the cylinder liner varies depending on the circumferential position of the cylinder liner. The variation of the thermal conductivity of the cylinder liner causes the thermal expansion ratio of the cylinder liner to vary depending on the circumferential position thereof.

Because of the above, it is possible that the cylinder liner expands without maintaining a perfect circular shape, and the inner surface of the cylinder liner, i.e., inner surface of the cylinder bore is deformed to have a distorted cylindrical shape. A piston reciprocatingly moves in the deformed cylinder bore, so that the coefficient of friction between the piston and the cylinder liner is increased. As a result, engine oil consumption and abrasion of the piston ring are increased, and hence this can be a cause of increased fuel consumption, decrease of performance, and short life of the engine.

Furthermore, it is possible that water may penetrate into the gap formed at the interface between the cylinder liner and the cylinder block main body. In this case, the cylinder liner can corrode, and the corrosion may lead to deformation of the cylinder liner.

A load is applied to the cylinder liner in the course of treating/processing the inner surface of the cylinder bore. When the gap is formed at the interface between the cylinder block main body and the cylinder liner, the load is applied non-uniformly to the cylinder liner. Accordingly, elastic deformation, that is, spring-back of the cylinder liner occurs, and a cylinder block is manufactured with decreased accuracy. When a load is repeatedly applied to the cylinder liner, the cylinder liner is deformed with the passage of time.

Likewise, when the cylinder block main body is processed by a machine, a load is applied non-uniformly to the cylinder block around the gap. Then a part of the cylinder block main body with a small thickness, which is formed around the gap, causes elastic deformation when a load is applied thereto. Accordingly, it is difficult to manufacture a cylinder block with good accuracy.

An aluminum cylinder block is formed by casting an aluminum alloy around a cylinder liner. In the course of the solidification of the aluminum alloy, the interface between the cylinder liner and the cylinder block main body receives a large load generated by the residual stress mainly of the aluminum alloy, and the thermal expansion ratio comes to be difference between the aluminum alloy and iron for the cylinder liner. When a gap is formed at the interface between the cylinder liner and the cylinder block main body, the stress is concentrated in the parts around the gap. Therefore, it is possible that an aluminum alloy cylinder block main body is damaged. In particular, a part of the cylinder block main body with a small thickness may be damaged when the stress is concentrated in the part.

As a countermeasure, a method for producing a cylinder block is known. Namely, a shot blasting is carried out with respect to the outer surface of the iron cylinder liner by using steel in the form of particles, for activating the surface and for obtaining a rough surface. When an aluminum cylinder block is manufactured with the cylinder block, a close contact is obtained at the interface between the cylinder liner and the cylinder block main body.

In addition to the above, other processes for preparing cylinder blocks are disclosed in Japanese Kokai Publications 2001-227404, 2001-334357, and 7(1995)-139419. According to the publications, a plurality of grooves or protrusions in the form of stripes is integrally formed in the surface of the cast iron cylinder liner. The cylinder liner and the cast cylinder block main body are closely contacted with each other.

Furthermore, another method for producing a cylinder block is known. In the method, a metal is applied to the cylinder block by plating. Examples of the metal in the method include a Cu-based metal and Zn-based metal which having good fusing characteristics with respect to the melt of the aluminum alloy. Then, a gas component such as hydrogen contained in the plated layer is eliminated by immersing the cylinder liner in a flux bath. Subsequently, the thus treated cylinder liner is provided in the cylinder block main body by casting aluminum therebetween. Accordingly, a close contact is obtained at the interface between the cylinder liner and the cylinder block main body.

The above-mentioned method by use of the shot blasting can be carried out by the expense of relatively small cost, and the flowability of the aluminum alloy is increased. Moreover, the contact between the cylinder block main body and the cylinder liner is increased. On the other hand, the bond strength between the cylinder block main body and the cylinder liner is low. Therefore, the cylinder liner tends to be affected by stress such as residual stress or shrinkage generated by the solidification of the melt of the aluminum alloy used for casting. Consequently, it is difficult to obtain a regularly formed interface between the cylinder block main body and the cylinder liner.

In the method disclosed in the previously mentioned publications, where a plurality of grooves or protrusions in the form of stripes is integrally formed on the outer surface of the cylinder liner, the bonding strength is increased to some extent by a mechanical reason. On the other hand, however, the grooves or the protrusions in the form of stripes hinder the flow of the melt of the aluminum alloy. Therefore, it is possible that the interface between the cylinder liner and the cylinder block main body has an irregular contacting state. In other words, close contacting state is partially obtained at the interface. Moreover, there are limitations for forming a plurality of protrusion on the outer surface of the cylinder liner by the treatment by a machine, and it is possible that the manufacturing cost is increased.

In the above-mentioned technology wherein a metal such as Cu-based or Zn-based metal is plated on the outer surface of the cylinder liner, the thickness of the layer obtained by plating (plating layer) with Cu-based material or Zn-based material could be varied. Therefore, the contacting state between the cylinder liner and the plated layer may be made irregular. Such variation and irregularity largely influence the surface structure of the cylinder liner. If the thickness of the plating layer, or contacting state between the plating layer and the cylinder liner varies when the melt of aluminum alloy is introduced, a metal compound is formed by the reaction between the plating layer and the aluminum alloy. As a result, a layer with non-uniform thickness is obtained from the metal compound. Consequently, irregular interfaces are formed, and the interface may have a gap and unstable bonding strength.

OBJECT AND SUMMARY OF THE INVENTION

It is therefore a first object of the present invention to provide a cylinder liner which controls gap formation at the interface between the cylinder liner and a cylinder block main body for accepting the cylinder liner therein, and serves to obtain stable contacting state and excellent bonding strength between the cylinder liner and the cylinder block main body.

The object of the present invention is achieved by a cast iron cylinder liner having a cylindrical shape to be used for casting an aluminum alloy cylinder block, comprising a plurality of grooves formed on an outer surface of the cylinder liner, each of the grooves extending in a circumferential direction of the cylinder liner in a ring shape, the grooves dividing the outer surface of the cylinder liner into a plurality of ring sections extending in a circumferential direction of the cylinder liner, each of the grooves being positioned between the ring sections by alternatively forming the grooves and the ring sections, outer surfaces of the ring sections having a uniform transverse distance from the central axis of the cylinder liner over the entire area of the outer surfaces, the grooves being arranged symmetrically with respect to the center of the cylinder liner in an axal direction thereof, each of the grooves having a J-shaped longitudinal cross-section including a first inclination part and a groove bottom part, the first inclination part extending from the outer surface of one of the ring sections toward the center of the cylinder liner in an axial direction thereof, the groove bottom part having a longitudinal cross-section approximately in the form of a circular arc, the groove bottom part extending from the first inclination part in a direction away from the center of the cylinder liner in an axial direction thereof.

The first object of the present invention is also achieved by a cast iron cylinder liner having a cylindrical shape to be used for casting an aluminum alloy cylinder block, comprising at least two grooves formed on an outer surface of the cylinder liner, each of the grooves extending in the form of a spiral having a plurality of turns in a circumferential direction of the cylinder liner, the grooves dividing the outer surface of the cylinder liner into at least two spiral sections having a plurality of turns extending in a circumferential direction of the cylinder liner, each turn of the grooves being positioned between turns of the spiral sections, outer surfaces of the spiral sections having a uniform transverse distance from the central axis of the cylinder liner over the entire area of the outer surfaces, the grooves being arranged symmetrically with respect to the center of the cylinder liner in an axial direction thereof, each of the grooves having a J-shaped longitudinal cross-section including a first inclination part and a groove bottom part, the first inclination part extending from the outer surface of one of the turns of the spiral sections toward the center of the cylinder liner in an axial direction thereof, the bottom part having a longitudinal cross-section approximately in the form of a circular arc, the groove bottom part extending from the first inclination part in a direction away from the center of the cylinder liner in an axial direction thereof.

In the above-mentioned cylinder liner, it is preferable that each of the grooves further comprises a second inclination part extending from the groove bottom part, the second inclination part opposing the first inclination part and extending in a direction away from the center of the cylinder liner in an axial direction thereof. By the provision of the second inclination part, it is possible to form a proper undercut area in the grooves. Accordingly, the contacting state between the cylinder liner and the cylinder block, and the bonding strength therebetween are further improved. The grooves in the form of a spiral is continuously formed by placing a workpiece of a cylinder liner on a lathe, bringing a blade tool into contact with the outer surface of the workpiece, and moving the blade tool in a longitudinal direction of the workpiece.

It is also preferable that the cylinder liner having the groove in the form of a spiral further comprises a ring-shaped central gain on the outer surface of the cylinder liner, the central gain extending in a circumferential direction of the cylinder liner at the center of the cylinder liner in an axial direction thereof, the central gain at least partially overlapping with the groove formed closely to the center of the cylinder liner in an axial direction thereof. The provision of the central gain makes it easy to measure or judge the manufacturing condition of the groove such as the depth of the groove and makes it easy to perform deburring.

It is a second object of the present invention to provide a cylinder block wherein a gap is not formed at the interface between the cylinder liner and a cylinder block main body for accepting the cylinder liner therein, and which has stable contacting state and excellent bonding strength between the cylinder liner and the cylinder block main body.

The second object of the present invention is achieved by a cylinder block comprising: a cast iron cylinder liner having a cylindrical shape; and a cylinder block main body formed by casting an aluminum alloy around the cylinder liner, comprising: a plurality of grooves formed on an outer surface of the cylinder liner, each of the grooves extending in a circumferential direction of the cylinder liner in a ring shape, the grooves dividing the outer surface of the cylinder liner into a plurality of ring sections extending in a circumferential direction of the cylinder liner, each of the grooves being positioned between the ring sections by alternatively forming the grooves and the ring sections, outer surfaces of the ring sections having a uniform transverse distance from the central axis of the cylinder liner over the entire area of the outer surfaces, the grooves being arranged symmetrically with respect to the center of the cylinder liner in an axial direction thereof, each of the grooves having a J-shaped longitudinal cross-section including a first inclination part and a groove bottom part, the first inclination part extending from the outer surface of one of the ring sections toward the center of the cylinder liner in an axial direction thereof, the groove bottom part having a longitudinal cross-section approximately in the form of a circular arc, the groove bottom part extending from the first inclination part in a direction away from the center of the cylinder liner in an axial direction thereof.

The second object of the present invention is also achieved by a cylinder block comprising a cast iron cylinder liner having a cylindrical shape, and a cylinder block main body formed by casting an aluminum alloy around the cylinder liner, comprising: at least two grooves formed on an outer surface of the cylinder liner, each of the grooves extending in the form of a spiral having a plurality of turns in a circumferential direction of the cylinder liner, the grooves dividing the outer surface of the cylinder liner into at least two spiral sections having a plurality of turns extending in a circumferential direction of the cylinder liner, each turn of the grooves being positioned between turns of the spiral sections, outer surfaces of the spiral sections having a uniform transverse distance from the central axis of the cylinder liner over the entire area of the outer surfaces, the grooves being arranged symmetrically with respect to the center of the cylinder liner in an axial direction thereof, each of the grooves having a J-shaped longitudinal cross-section including a first inclination part and a groove bottom part, the first inclination part extending from the outer surface of one of the turns of the spiral sections toward the center of the cylinder liner in an axial direction thereof, the bottom part having a longitudinal cross-section approximately in the form of a circular arc, the groove bottom part extending from the first inclination part in a direction away from the center of the cylinder liner in an axial direction thereof.

In the above-mentioned cylinder block, it is preferable that each of the grooves in the cylinder liner comprises a second inclination part extending from the groove bottom part, the second inclination part opposing the first inclination part and extending in a direction away from the center of the cylinder liner in an axial direction thereof. Accordingly, the contacting state between the cylinder liner and the cylinder block, and the bonding strength therebetween are further improved.

It is also preferable that the cylinder liner having the groove in the form of a spiral, which is provided in the cylinder block, further comprises a ring-shaped central gain on the outer surface of the cylinder liner, the central gain extending in a circumferential direction of the cylinder liner at the center of the cylinder liner in an axial direction thereof, the central gain at least partially overlapping with the groove formed closely to the center of the cylinder liner in an axial direction thereof. The provision of the central gain makes it easy to measure or judge the manufacturing condition of the groove such as the depth of the groove and makes it easy to perform deburring.

BRIEF DESCRIPTION OF THE DRAWINGS

A more complete appreciation of the invention and many of the attendant advantages thereof will be readily perceived as the same becomes better understood by reference to the following detailed description when considered in connection with the accompanying drawings, wherein:

FIG. 21 is a table for showing a relationship among cutting edge angle, pitch of a cylinder liner, productivity of a cylinder liner, and contacting state at the interface between the cylinder liner and a cylinder liner main body, according to the present invention;

FIG. 23 is a table for showing a relationship among cutting edge angle, pitch of a cylinder liner, productivity of a cylinder liner, and contacting state at the interface between the cylinder liner and a cylinder liner main body, according to the present invention.

DETAILED DESCRIPTION OF THE INVENTION

Other features of this invention will become apparent in the course of the following description of exemplary embodiments, which are given for illustration of the invention and are not intended to be limiting thereof.

A cylinder liner and a cylinder block of the present invention will be explained by referring to figures.

FIRST EMBODIMENT

FIGS. 1 to 10 describe a first embodiment of a cylinder liner and a cylinder block according to the present invention.

Figure 1:
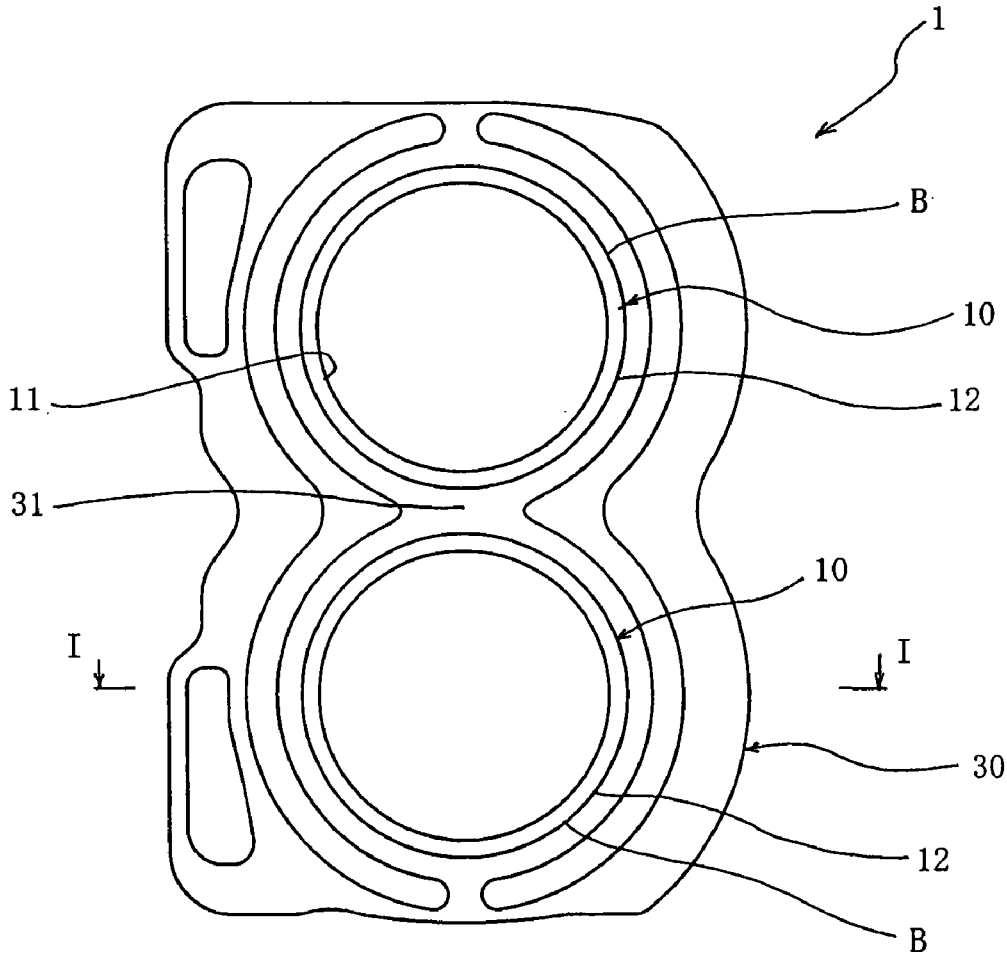
FIG. 1 is a plane view of a cylinder block according to the present invention.
Figure 2:
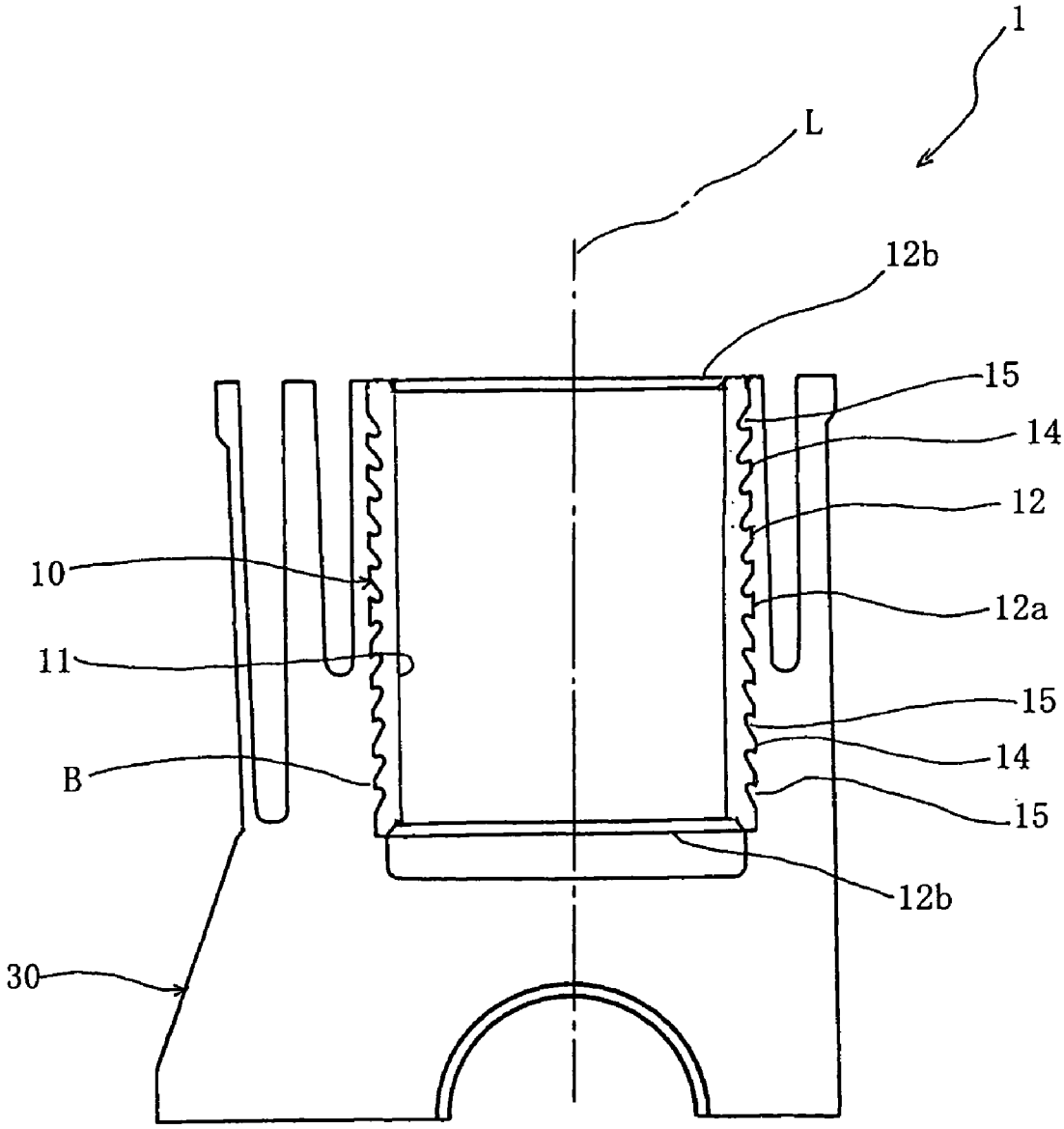
FIG. 2 is a cross-section of the cylinder liner shown in FIG. 1 seen from a part cut along a line I-I therein.
Figure 3:
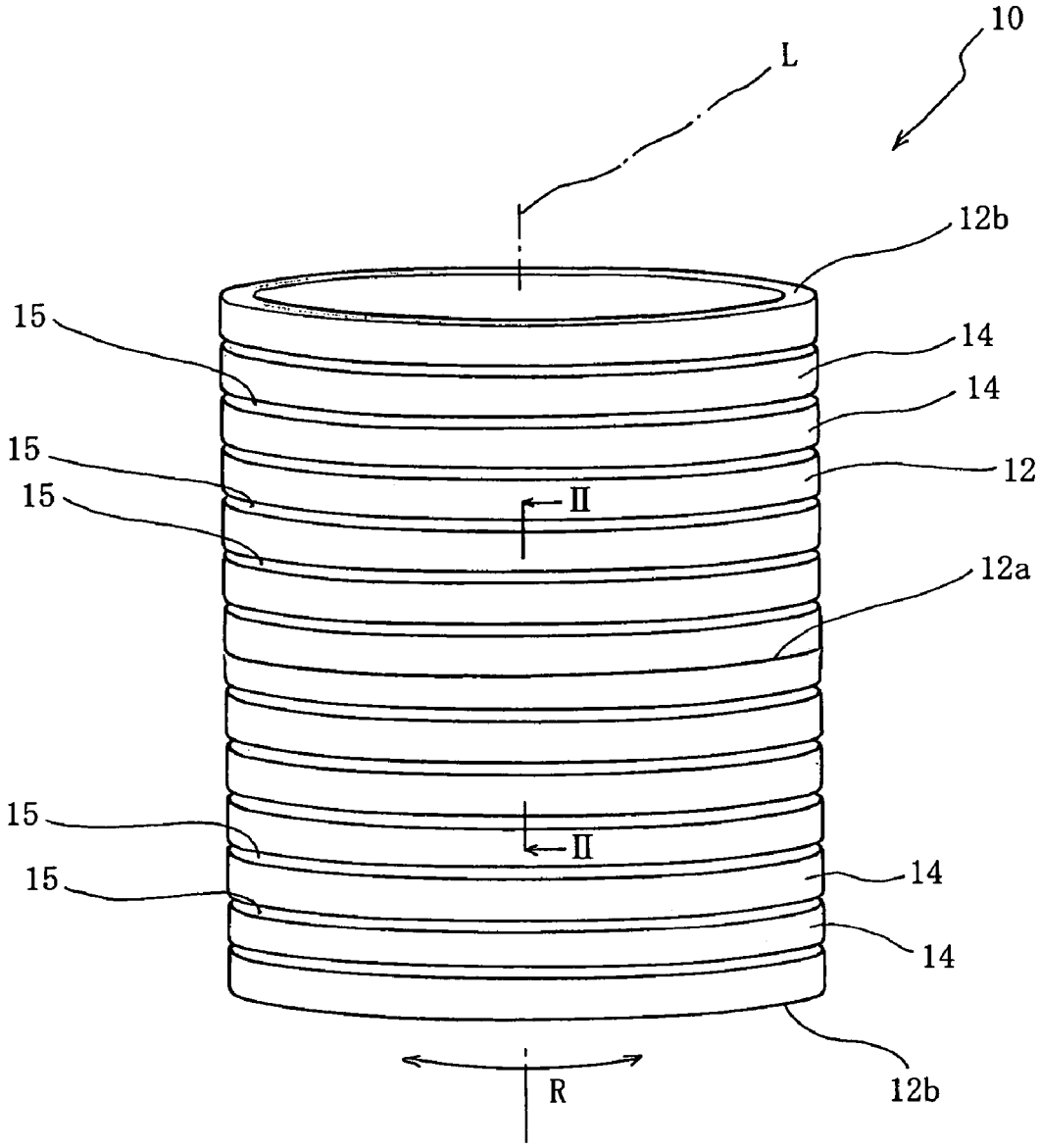
FIG. 3 is a perspective view of a cylinder liner according to the present invention.

FIG. 1 is a plane view of a cylinder block 1 including a cast iron cylinder liner 10 provided in an aluminum alloy cylinder block main body 30 by casing the aluminum alloy. FIG. 2 is a cross-section of the cylinder block 1 shown in FIG. 1 obtained by cutting along a line I-I therein. FIG. 3 is a perspective view of the cylinder liner 10, FIG. 4 is a side view of the cylinder liner 10, and FIG. 5 is an expanded cross-sectional view of the cylinder liner 10 shown in FIG. 3 which is obtained by cutting along a line II-II in FIG. 3.

Figure 4:
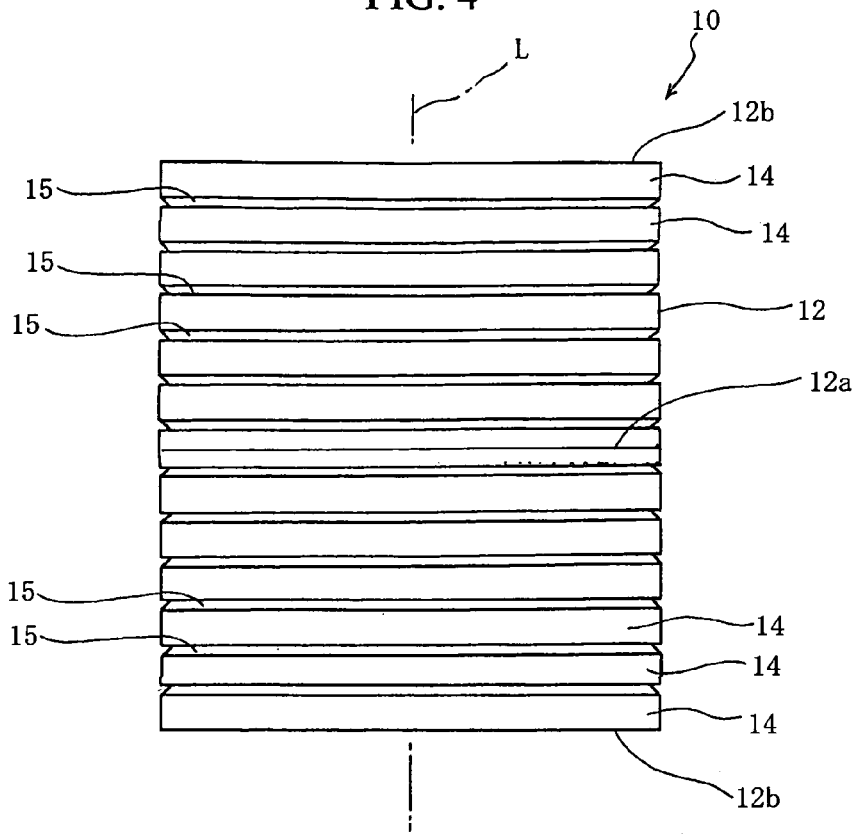
FIG. 4 is a side view of a cylinder liner according to the present invention.
Figure 5:
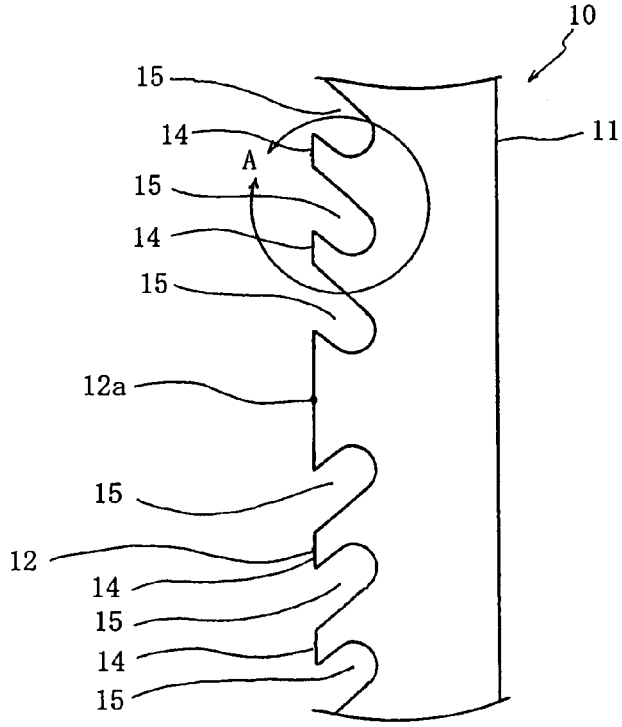
FIG. 5 is an expanded cross-section of the cylinder liner shown in FIG. 3 seen from a part cut along a line II-II.

As shown in FIGS. 3 to 5, the cylinder liner 10 has a cylindrical shape, extending in a direction of a central axis L. The cylinder liner 10 has a cross-section in the form of a circle drawn around the central axis L. The cylinder liner 10 has an inner surface 11 and an outer surface 12.

A plurality of grooves 15 are formed on the outer surface 12 of the cylinder liner 10. The grooves 15 are formed in a ring shape and extending in a circumferential direction R of the cylinder liner 10. By the provision of the ring-shaped grooves 15, the outer surface 12 of the cylinder 10 is divided into a plurality of ring sections 14. The ring sections 14 are arranged symmetrically with respect to a centerline 12*a* of the cylinder liner 10 which crosses at a right angle with the central axis L thereof. The ring sections 14 and the grooves 15 are alternatively arranged in the direction of the central axis L, so that the plurality of grooves are spaced apart from each other.

Figure 6:
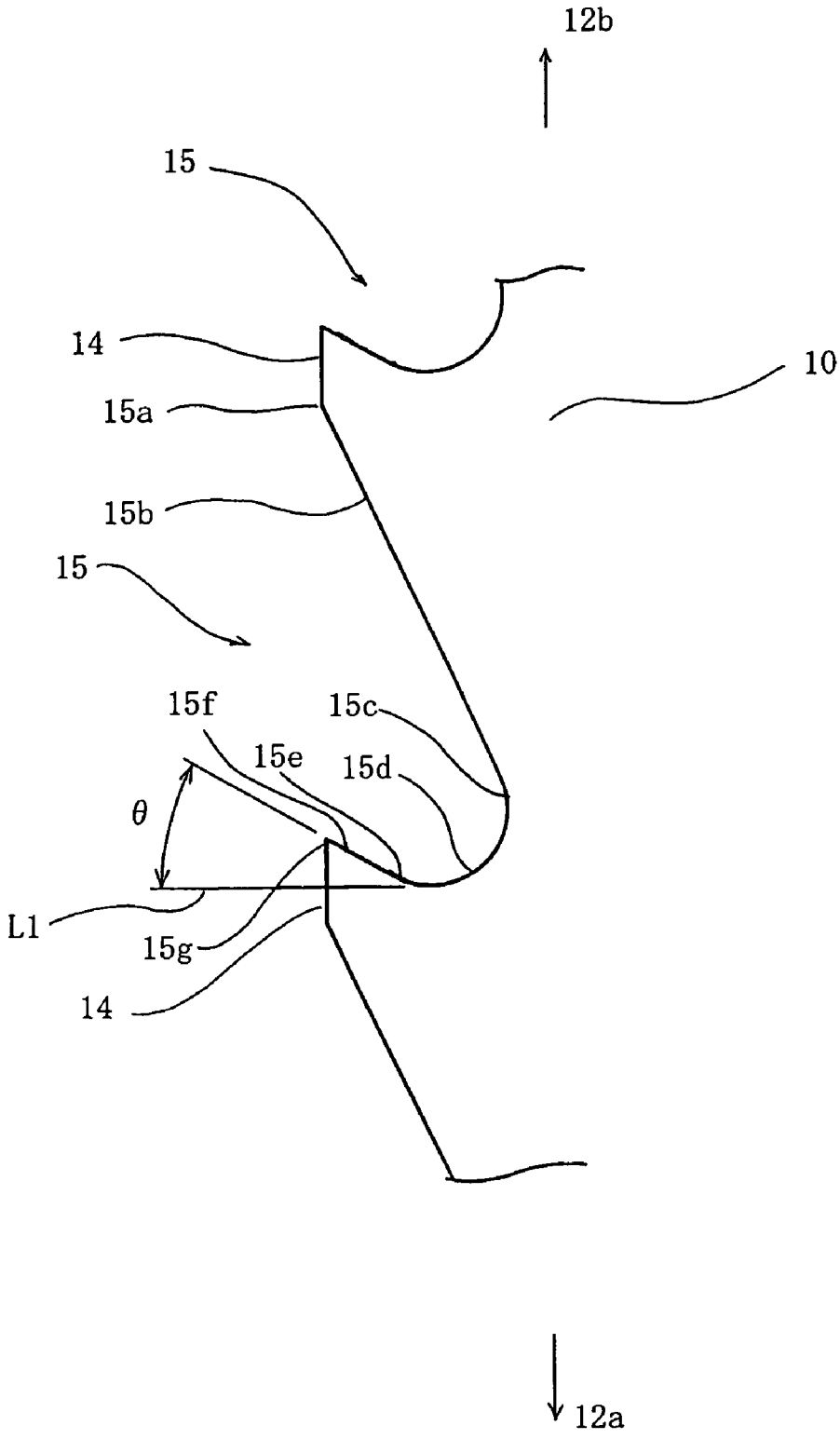
FIG. 6 is an expanded view of part A shown in FIG. 5.

FIG. 6 is an expanded longitudinal cross-section of part A shown in FIG. 5. In the figure, an arrow 12*b* and an arrow 12*a* respectively show an upper direction and a lower direction with respect to the cylinder liner.

In the upper half of the cylinder in FIG. 6, each of the grooves 15 has a J-shaped longitudinal cross-section. The J-shaped cross section is defined by a first inclination part 15*b*, a groove bottom part 15*d*, and a second inclination part 15*f*. The first inclination part 15*b* extends from the outer surface of one of the ring sections 14 toward the center of the cylinder liner 10 in an axial direction thereof. The outer surface of the ring section 14 and the first inclination part 15*b* meet at a point 15*a* at a predetermined angle. The groove bottom part 15*d* has a longitudinal cross-section approximately in the form of a circular arc, and the circular arc extends from an end point 15*c* of the first inclination part 15*b* in a direction away from the central axis L. The second inclination part 15*f* extends from an end point 15*e* of the circular arc, and then the outer surface of an adjacent ring section 14 extends from an end point 15*g* the second inclination part 15*f*. Accordingly, the J-shaped groove 15 is formed between the ring sections 14.

It is preferable that the second inclination part 15*f* is inclined at an angle θ of 3° to 35° with respect of a standard line L1 which extends in an axial direction of the cylinder liner 10 and crosses at a right angle with the central axis L. An undercut is formed in the area from the end point 15*e* of the groove bottom part 15*d* to the end point 15*g* of the second inclination part 15*f*.

A plurality of the cylinder liners 10 with the above-mentioned surface structure is used for manufacturing a cylinder block 1. As shown in FIG. 1, it is possible to place two cylinder liners 10 in parallel with each other in a mold. Then, a cylinder block 1 is obtained by casting aluminum alloy, as shown in FIGS. 1 and 2, whereby the aluminum ally cylinder block main body 30 is formed integrally with the cylinder liner 10.

Figure 7:
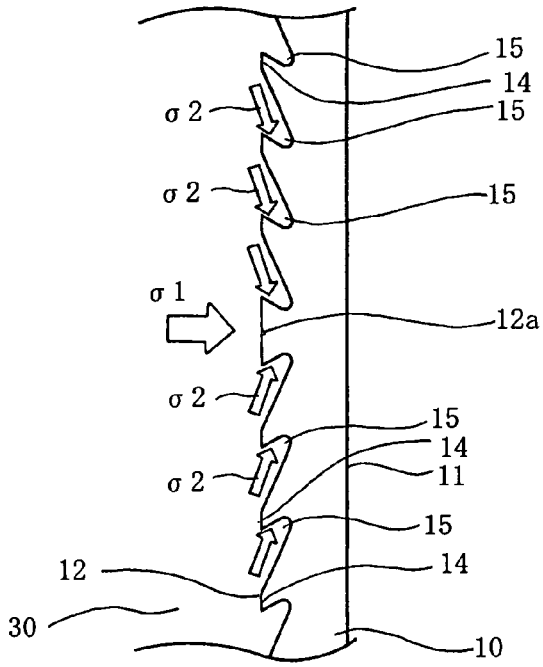
FIG. 7 is a diagram for explaining the effect of shrinkage stress obtained by solidification and shrinkage of the melt of an aluminum alloy.
Figure 8:
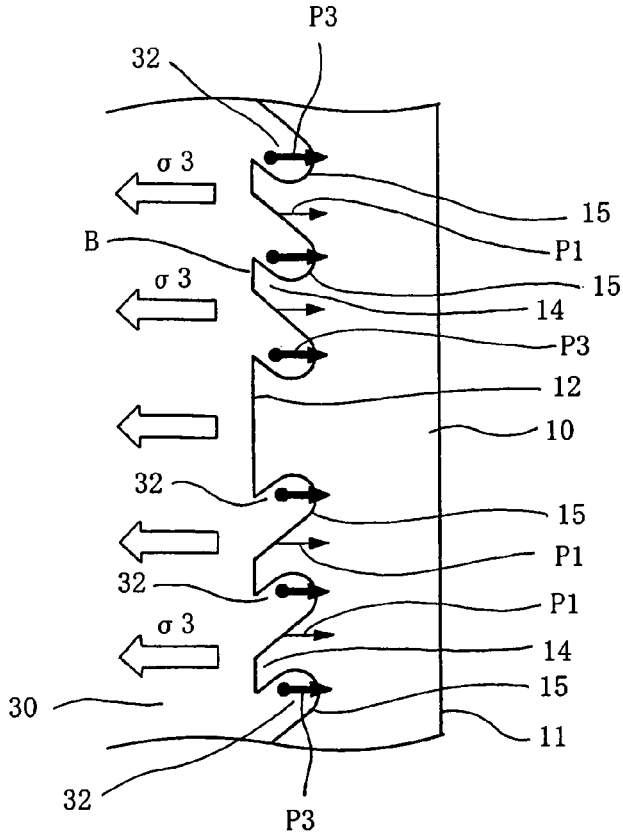
FIG. 8 is a diagram for explaining ablation stress applied to a cylinder block according to the present invention.

FIG. 7 is a diagram for explaining the effect of shrinkage stress obtained by solidification and shrinkage of the melt of an aluminum alloy. Moreover, FIG. 8 is a diagram for explaining ablation stress applied to a cylinder block.

In the casting process, the melt of aluminum alloy flows into the grooves 15 of the cylinder liner 10 and other parts in the mold. When the melt is solidified and shrunk, a shrinkage stress shown by arrow σ1 generates in the aluminum alloy in a radial direction toward the center of the cylinder liner 10. On the other hand, a shrinkage stress shown by arrow σ2 generates in the aluminum alloy in an axial direction of the cylinder liner 10. The shrinkage stress σ2 is uniformly received by the symmetrically formed grooves 15 of the cylinder liner 10 all over the surface thereof. Therefore, the aluminum alloy is caught by the cylinder liner 10, and the movement in an axial direction of the cylinder liner 10 is restrained. Since the shrinkage stress σ2 is uniformly dispersed to the outer surface of the cylinder liner 10, the residual stress on the aluminum alloy after completion of shrinkage is reduced and uniformly dispersed. Accordingly, the residual stress in the cylinder block main body 30, particularly at the part 31 with a small thickness of the cylinder block main body 30 is reduced. Namely, it is possible to prevent the cylinder block main body 30 from cracking.

Furthermore, it is possible that a large load is applied to the aluminum alloy cylinder block main body 30 having the cast iron cylinder liner 10, when residual stress generates in the course of aluminum solidification and shrinkage, and when thermal expansion irregularly/locationally occurs depending on a peripheral part the cylinder liner 20. Then, ablation stress shown by arrow σ3 may generate in the direction of disconnecting the cylinder block main body 30 from the outer surface of the cylinder liner 10, as shown in FIG. 8.

Parts 32 of the cylinder block main body 30, which are enclosed by the grooves 15 of the cylinder liner 10, are caught by the grooves 15, particularly by the undercut part, i.e., in the area in the vicinity of the end point 15*e* of the groove bottom part 15*d* to the end point 15*g* of the second inclination part 15*f* (FIG. 6), against the ablation stress σ3. Therefore, opposing force shown by arrow P3 generates, and hence adhesion force shown by arrow P1 is attained between the cylinder liner 10 and the cylinder block main body 30, as shown in FIG. 8. As a result, the cylinder liner 10 and the cylinder block main body 30 closely contact with each other without forming a gap at the interface therebetween.

Figure 9:
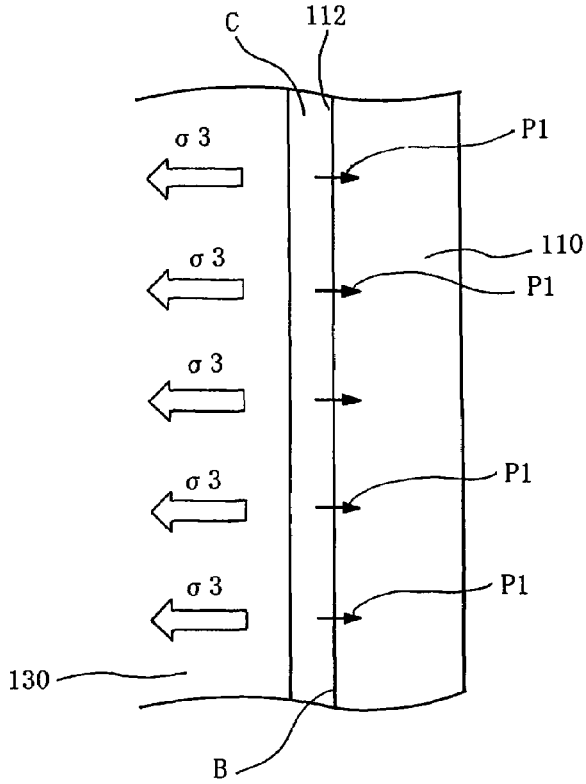
FIG. 9 is a diagram for explaining stress applied to a cylinder block without grooves.

Comparative to the above embodiment of the present invention, FIG. 9 shows a diagram for explaining stress applied to a cylinder liner 110 without grooves. When a cast aluminum alloy cylinder block contains the cylinder liner 110 with a smooth surface, the ablation stress shown by arrow σ3 generates as the result of residual stress or irregular thermal expansion as previously discussed. The ablation stress σ3 affects in the direction of disconnecting a cylinder block main body 130 from the cylinder liner 110. The ablation stress σ3 opposes adhesion force P1 between the cylinder liner 110 and the cylinder block main body 130. Therefore, it is possible that the cylinder block main body is disconnected from the cylinder liner 110. In this way, when the cylinder liner 110 without the grooves in the surface thereof is used in a cylinder block, it is possible that a gap C is formed at an interface B between the cylinder liner 110 and the cylinder block main body 130.

Figure 10:
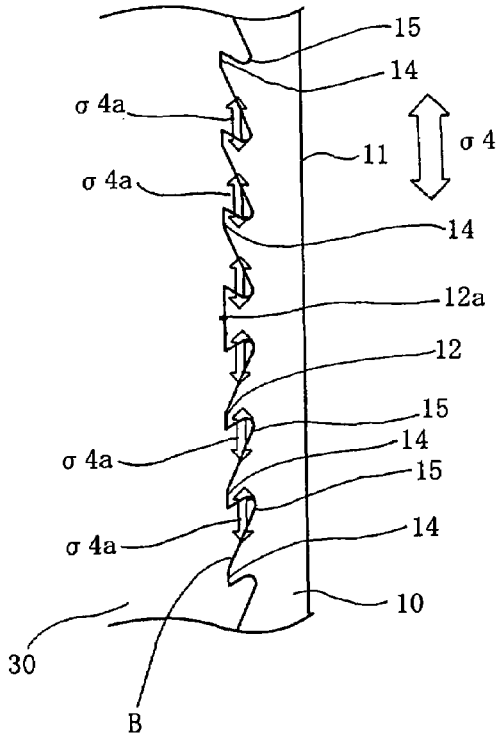
FIG. 10 is a diagram for explaining shearing stress applied to a cylinder block according to the present invention.

FIG. 10 is a diagram for explaining shearing stress applied to a cylinder block according to the present invention.

In the cylinder liner 10, each of the grooves 15 with an inclined J-shaped cross-section is formed between the ring parts 14. A shearing stress σ4 is applied, for instance, from a piston to the cylinder liner 10 in an axial direction thereof, and components σ4*a* of the shearing stress σ4 are transmitted along the contour of the grooves 15 and received by the grooves 15. This means that the shearing stress σ4 is dispersed to all over the interface B between the cylinder liner 10 and the cylinder block 30. As a result, close contact is attained at the interface between the cylinder liner 10 and the cylinder block main body 30 without forming a gap therebetween.

In the thus formed cylinder block 1, a uniform thermal conductivity is obtained in the cylinder liner 10 and the cylinder block main body 30 both in the axial direction and the circumferential direction of the cylinder liner 10. Based on the good thermal conductivity, the cooling process of the engine is improved, and the thermal expansion of the cylinder liner 10 is controlled to be uniform. As a result, the cylinder liner 10 expands by maintaining a perfect circle shape, and the inner surface 11 of the cylinder liner 10 maintain the cylindrical shape with a cross-section as a perfect circle. Accordingly, it is possible to minimize a friction caused by a piston which makes a reciprocating movement in the cylinder block 1. If the coefficient of friction is lowered as regards the cylinder liner 10 and the piston, engine oil consumption and abrasion of the piston ring are decreased, and combustion, performance and life of the engine are increased.

In the course of treating/processing the inner surface 11 of the cylinder liner 10, a load is applied to the thereto. Since the cylinder block according to the present invention does not have a gap at the interface between the cylinder liner 10 and the cylinder block 30, and has a good contact state and bonding strength therebetween, elastic deformation of the cylinder liner 10 does not occur and the cylinder block can be manufactured with improved accuracy. Furthermore, deformation of the cylinder liner 10 is prevented even after passage of time.

In addition to the above, water cannot penetrate into the cylinder block because the interface between the cylinder liner 10 and the cylinder block main body 30 is in a closely connected state. Therefore, corrosion or deformation resulted therefrom does not occur.

According to the present invention, as explained, a cylinder block 1 with a high quality is obtained.

SECOND EMBODIMENT

FIGS. 11 to 23 describe a second embodiment of a cylinder liner 20 and a cylinder block 1 according to the present invention.

Figure 11:
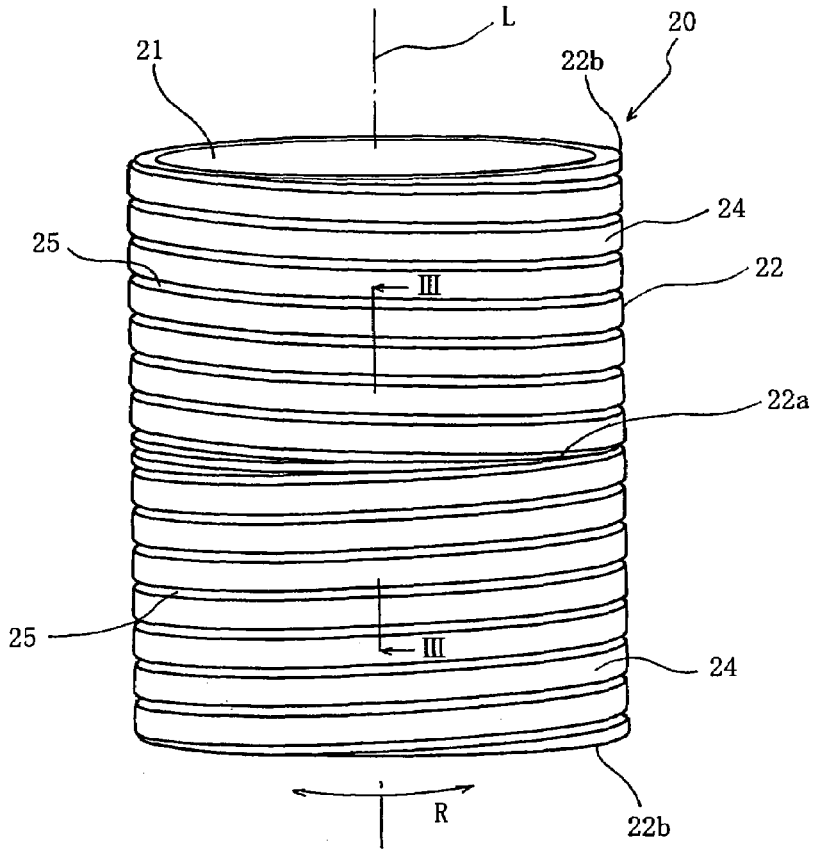
FIG. 11 is a perspective view of a cylinder liner according to the present invention.
Figure 12:
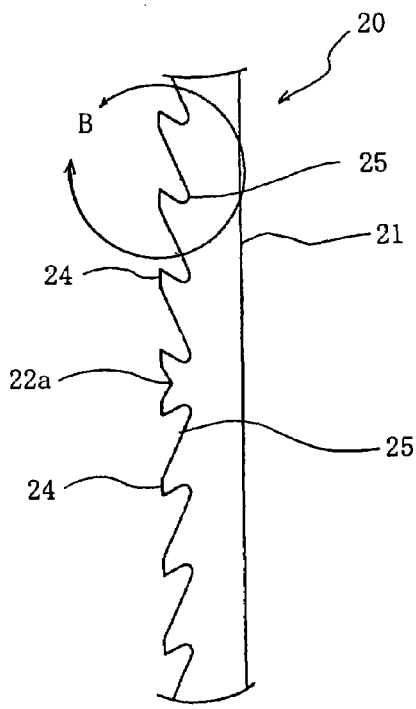
FIG. 12 is an expanded cross-section of the cylinder liner shown in FIG. 11 seen from a part cut along a line III-III.

FIG. 11 is a perspective view of a cast iron cylinder liner 20 according to the present invention. FIG. 12 is an expanded cross-sectional view of the cylinder liner 20 shown in FIG. 11 which is obtained by cutting along a line III-III therein.

As shown in FIGS. 11 and 12, the cylinder liner 20 has a cylindrical shape, extending in a direction of a central axis L. The cylinder liner 20 has a cross-section in the form of a circle drawn around the central axis L. The cylinder liner 20 has an inner surface 21 and an outer surface 22.

Grooves 25 are formed on the outer surface 22 of the cylinder liner 20. The grooves 25 extend in the form of a spiral having a plurality of turns in a circumferential direction R of the cylinder liner 20. By the provision of the grooves 25 with a spiral shape, the outer surface 22 of the cylinder liner 20 is divided into spiral sections 24. The spiral sections 24 are arranged symmetrically with respect to a centerline 22*a* of the cylinder liner 20 which crosses with the central axis L at a right angle. Therefore, the winding directions of the spiral sections 24 in the upper half and the lower half in FIG. 11 are reversed with respect to each other. Each turn of the spiral sections 24 are provided between turns of the spiral section 24.

Figure 13:
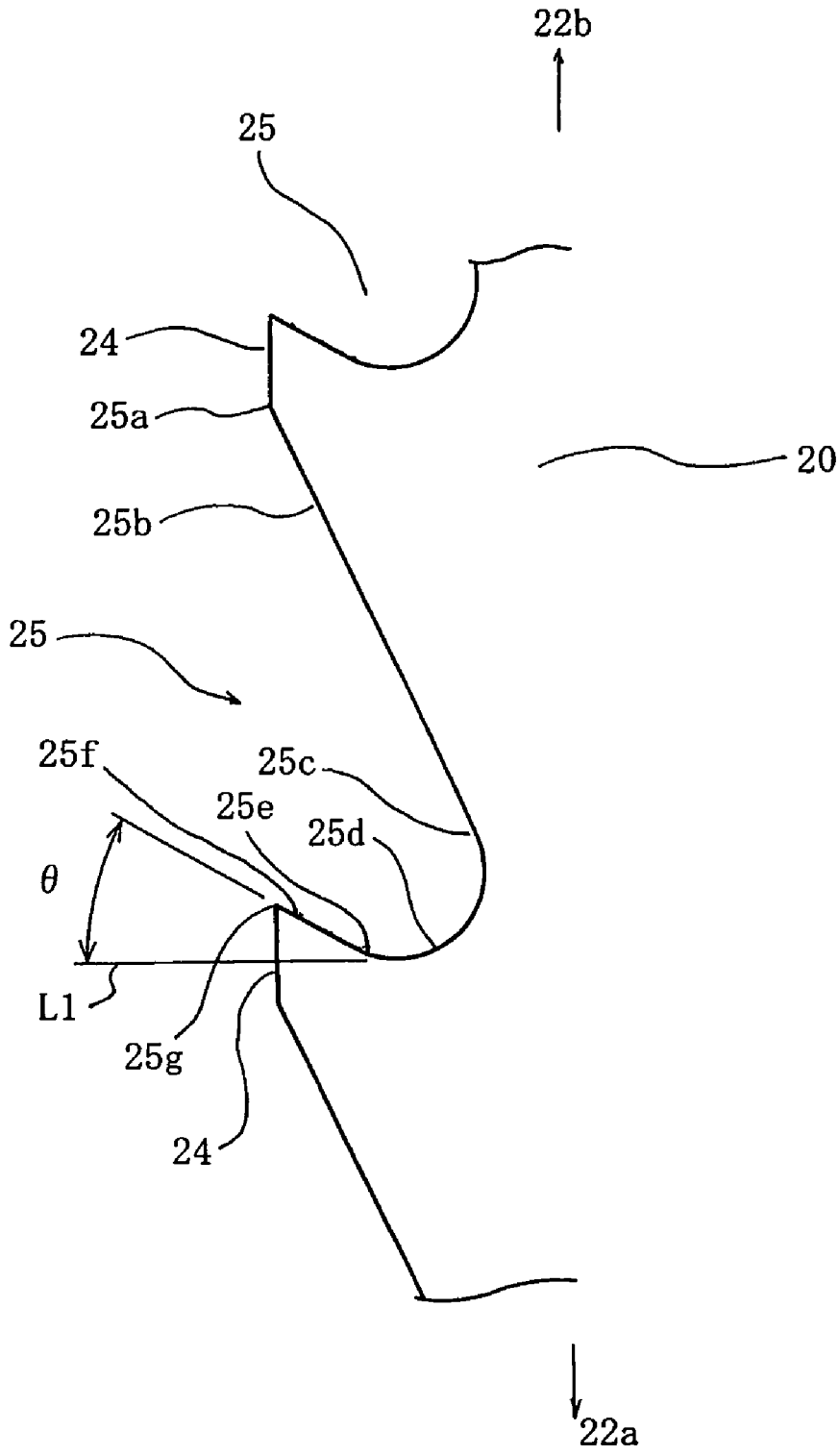
FIG. 13 is an expanded view of part B shown in FIG. 12.

FIG. 13 is an expanded longitudinal cross-section of part B shown in FIG. 12. In the figure, an arrow 22*b* and an arrow 22*a* respectively show an upper direction and a lower direction with respect to the cylinder liner 20.

In the upper half of the cylinder in FIG. 13, each of the grooves 25 has a J-shaped longitudinal cross-section. The J-shaped cross section is defined by a first inclination part 25*b*, a groove bottom part 25*d*, and a second inclination part 25*f*. The first inclination part 25*b* extends from the outer surface of one turn of the spiral sections 24 toward the center of the cylinder liner 20 in an axial direction thereof. The outer surface of the spiral section 24 and the first inclination part 25*b* meet at a point 25*a* at a predetermined angle. The groove bottom part 25*d* has a longitudinal cross-section approximately in the form of a circular arc, and the circular arc extends from an end point 25*c* of the first inclination part 25*b* in a direction away from the central axis L. The second inclination part 25*f* extends from an end point 25*e* of the circular arc, and then, the outer surface of an adjacent turn of the spiral section 24 extends from an end point 25*g* the second inclination part 25*f*. Accordingly, the J-shaped groove 25 is formed between the turns of the spiral sections 24.

It is preferable that the second inclination part 25*f* is inclined at an angle θ of 3° to 35° with respect of a standard line L1 which extends in an axial direction of the cylinder liner 20 and crosses at a right angle with the central axis L. An undercut is formed in the range from the end point 25*e* of the groove bottom part 25*d* to the end point 25*g* of the second inclination part 25*f*.

Figure 14:
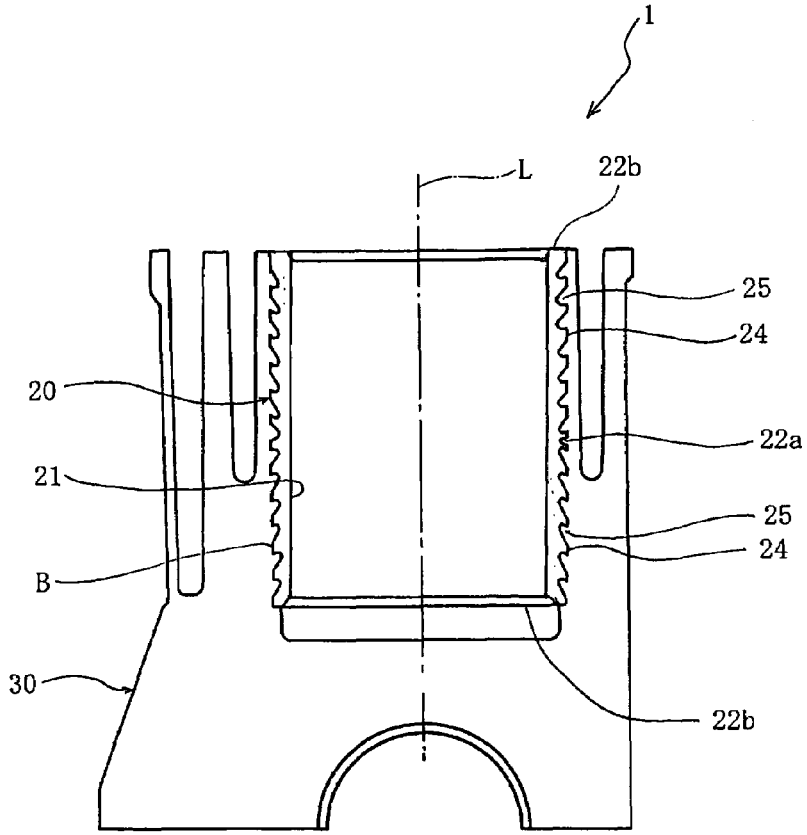
FIG. 14 is a cross section of a cylinder block according to the present invention.

A plurality of the cylinder liners 20 with the above-mentioned surface structure is used for manufacturing a cylinder block 1. As shown in FIG. 1, it is possible to place two cylinder liners 20 in parallel with each other in a mold. Then, a cylinder block 1 is obtained by casting aluminum alloy, as shown in FIG. 14, whereby the aluminum alloy cylinder block main body 30 is formed integrally with the cylinder liner 20.

Figure 15:
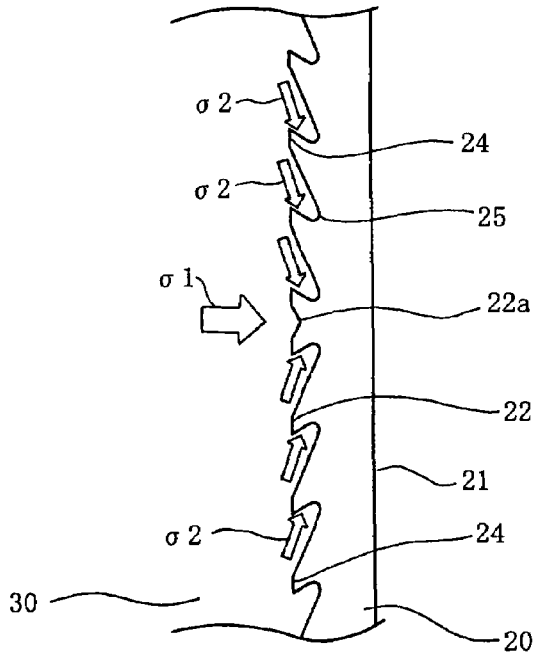
FIG. 15 is a diagram for explaining the effect of shrinkage stress obtained by solidification and shrinkage of the melt of an aluminum alloy.
Figure 16:
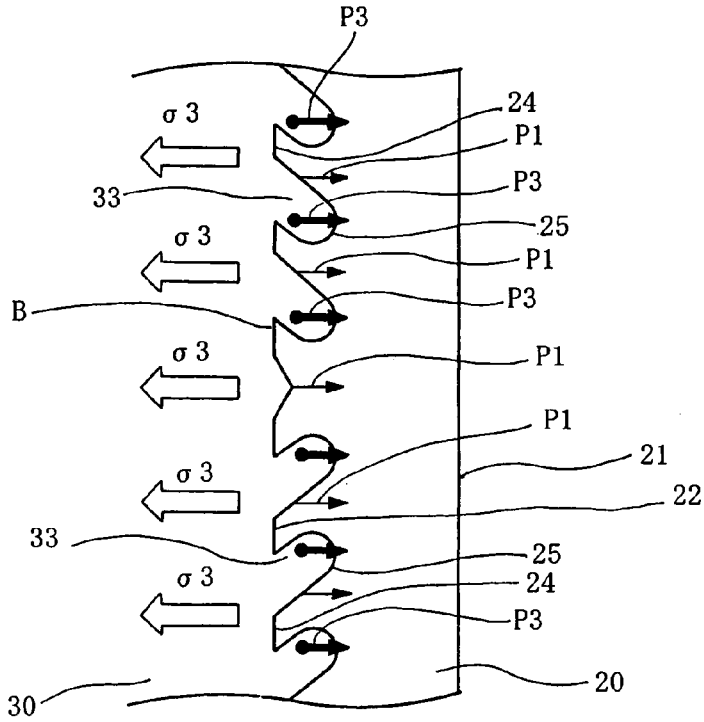
FIG. 16 is a diagram for explaining ablation stress applied to a cylinder block.

FIG. 15 is a diagram for explaining the effect of shrinkage stress obtained by solidification and shrinkage of the melt of an aluminum alloy. Moreover, FIG. 16 is a diagram for explaining ablation stress applied to a cylinder block 1.

In the casting process, the melt of aluminum alloy flows into the grooves 15 of the cylinder liner 20 and other parts in the mold. When the melt is solidified and shrunk, a shrinkage stress shown by arrow σ1 generates in the aluminum alloy in a radial direction toward the center of the cylinder liner 20. On the other hand, a shrinkage stress shown by arrow σ2 generates in the aluminum alloy in an axial direction of the cylinder liner 20. The shrinkage stress σ2 is uniformly received by the symmetrically formed grooves 25 of the cylinder liner 20 all over the surface thereof. Therefore, the aluminum alloy is caught by the cylinder liner 20, and the movement in an axial direction of the cylinder liner 20 is restrained.

As a result, the residual stress on the aluminum alloy after completion of shrinkage is reduced and uniformly dispersed. The aluminum alloy cylinder block 30 is stably supported by the cylinder liner 20 without applying a rotational force to the cylinder liner 20 with spiral-shaped grooves. This is because the spiral-shaped grooves are symmetrically formed with reversed winding directions, and the components of shrinkage stress σ1, which generate along the grooves in the winding directions, cancel each other. Since the residual stress in the cylinder block main body 30 is reduced, it is possible to prevent the cylinder block main body 30 from cracking.

Furthermore, it is possible that a large load is applied to the aluminum alloy cylinder block main body 30 having the cast iron cylinder liner 20, based on residual stress as mentioned above and irregular thermal expansion. FIG. 16 shows that ablation stress shown by arrow σ3 may generate in the direction of disconnecting the cylinder block main body 30 from the outer surface of the cylinder liner 20.

Figure 17:
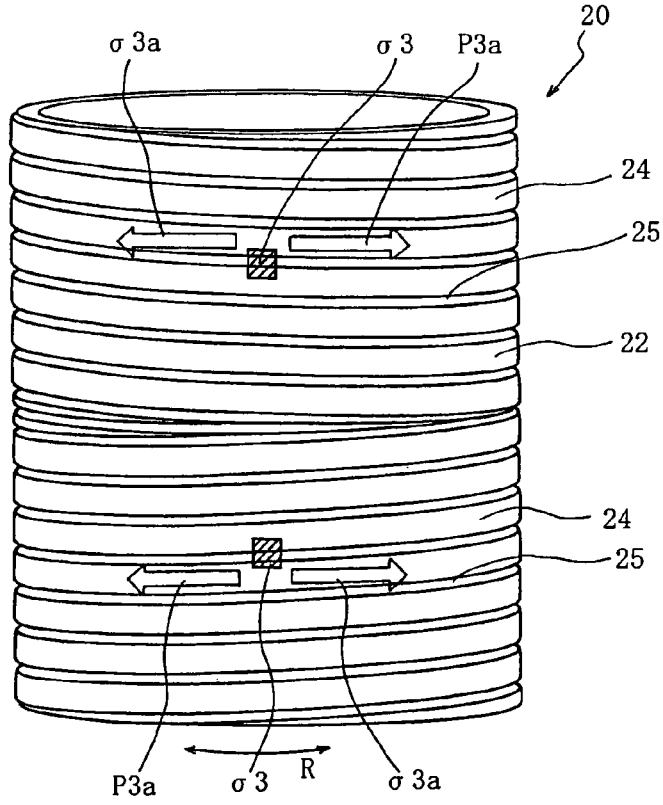
FIG. 17 is a diagram for explaining stress applied to a cylinder liner in a circumferential direction thereof.

FIG. 17 is a diagram for explaining ablation stress σ3 applied to the cylinder liner 20 in a circumferential direction thereof. A part of the ablation stress σ3 is dispersed as component σ3*a* thereof along the groove 25 formed in the surface of the cylinder liner 20.

Parts 33 of the cylinder block main body 30, which are enclosed by the grooves 25 of the cylinder liner 20, are caught by the grooves 25 in the form of a spiral, particularly by the undercut, i.e., in the vicinity of the end point 25*e* of the groove bottom part 25*d* to the end point 25*g* of the second inclination part 25*f* (FIG. 13), against the ablation stress σ3. Therefore, opposing force shown by arrow P3*a* generates, and hence adhesion force shown by arrow P1 are attained between the cylinder liner 20 and the cylinder block main body 30, as shown in FIG. 16. Therefore, it is possible to prevent the cylinder liner 20 from moving in a circumferential direction thereof. In other words, shearing stress in a circumferential direction is controlled at the interface between the cylinder liner 20 and the cylinder block main body 30.

Because of the symmetrical surface structure of the groove having a reversed winding direction from each other, stress σ3*a* in the circumferential direction and the opposing force P3*a* cancel each other. Therefore, the cylinder liner 20 is stably maintained without receiving rotational force, and a gap is not formed at the interface between the cylinder liner 20 and the cylinder block main body 30.

Figure 18:
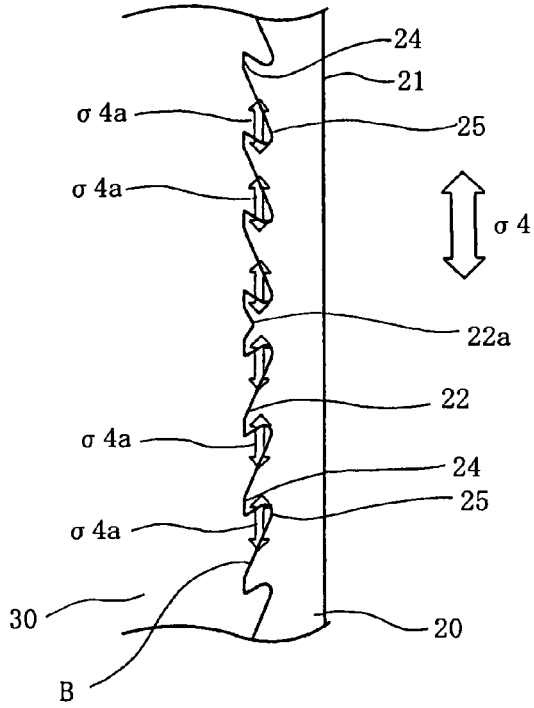
FIG. 18 is a diagram for explaining shearing stress applied to a cylinder block.

FIG. 18 is a diagram for explaining shearing stress applied to the cylinder liner 20 according to the present invention.

A shearing stress σ4 is applied, for instance, from a piston to the cylinder liner 20 in an axial direction thereof, and components σ4*a* of the shearing stress σ4 are received by the grooves 25. This means that the shearing stress σ4 is dispersed to all over the interface B between the cylinder liner 20 and the cylinder block 30. As a result, close contact is attained at the interface between the cylinder liner 20 and the cylinder block main body 30 without forming a gap therebetween.

Figure 19:
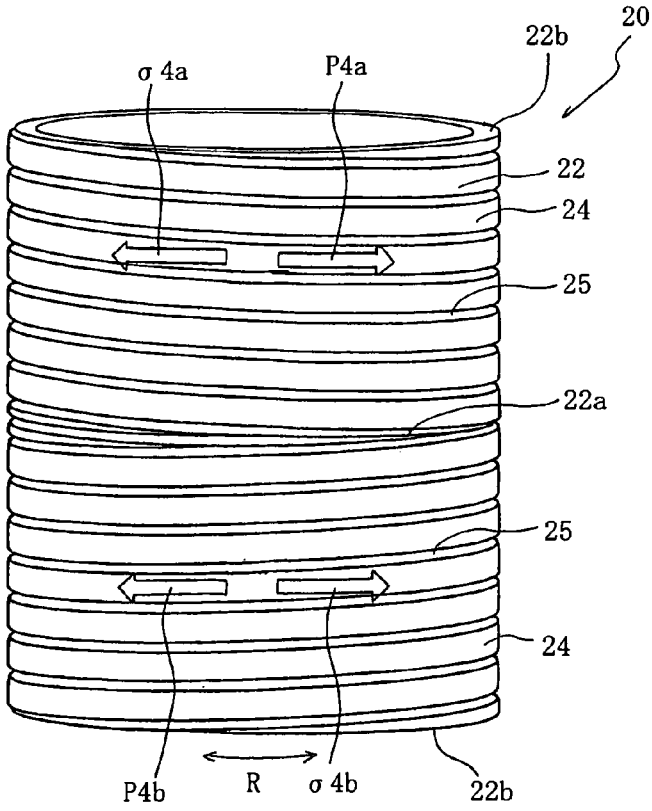
FIG. 19 is a diagram for explaining shearing stress applied to a cylinder block.

FIG. 19 is a diagram for explaining shearing stress applied to a cylinder block 20. In the lower half of the cylinder block 20, a part of shearing stress σ4 is dispersed as component σ4*b* thereof along the groove 25 formed in the surface of the cylinder liner 20. Against the component σ4*b*, opposing force P4*b* generates. Therefore, movement in a circumferential direction R along the grooves 25 of the cylinder liner 20 is restrained, and shearing stress in a circumferential direction R at the interface between the cylinder liner 20 and the cylinder block main body 30 are controlled. In the lower half of the cylinder liner 20, the shearing stress σ4*a* in a circumferential direction along the grooves 25 are cancelled by the opposing force P4*a*. Because the cylinder liner 20 has the outer surface with the symmetrically formed spiral-shaped grooves 25, the cylinder liner 20 is stably maintained in a predetermined position without receiving rotational force, and a gap does not generate at the interface B between the cylinder liner 20 and the cylinder block main body 30.

According to the present invention, similarly to the first embodiment, a cylinder block 1 with a high quality is obtained.

In comparison to the cylinder liner 20 with the ring parts 14 and grooves 15 therebetween, the cylinder liner 20 with spiral sections 24 the grooves 25 in the form of spirals can be effectively manufactured by using a manufacturing equipment such as a lathe. The spirals can be formed in the outer surface of the cast cylinder liner 20 by rotating a workpiece for the cylinder liner 20 around the central axis L with applying a process blade to the outer surface of the workpiece and moving the same along the central axis L. Accordingly, it is possible to improve the productivity, and to reduce the manufacturing cost when the spiral-shaped grooves 25 are formed on the cylinder liner 20, comparing to the production of the cylinder liner 10 having ring-shaped grooves.

When a spiral-shaped groove 25 is formed on the cylinder liner 20, it is preferable to use a process blade having a nose angle (angle made by end cutting edge and side cutting edge) in the range of 35° to 55° , corner radius of 0.4 mm, and to form a groove having a pitch in an axial direction in the range of 1 mm to 4 mm and a groove depth in the range of 0.5 mm to 1.2 mm. Accordingly, it is possible to effectively produce a cylinder liner 20 with proper grooves 25.

When the process pitch is less than 1 mm, it is difficult to properly form the second inclination part 25*f*, i.e., the undercut. On the other hand, when the process pitch is more than 4 mm, the total outer surface ratio of the spiral sections 24 becomes too large. In this case, the adhesion force at the interface B between the cylinder liner 20 and the cylinder block main body 30 may be decreased. Here, the outer surface of the ring sections 24 corresponds to the part which has been the outer surface of the cylinder liner before the grooves 25 were formed thereon (workpiece).

In addition to the above, when the groove depth exceeds 1.2 mm, a tool for carving the grooves is abraded significantly. Moreover, the groove which is deeper than 1.2 mm may adversely affect flowability of an aluminum alloy. This could make the mass production to be difficult. Therefore, it is preferable that the groove 25 is formed to have a depth within 1.5 mm.

Figure 20:
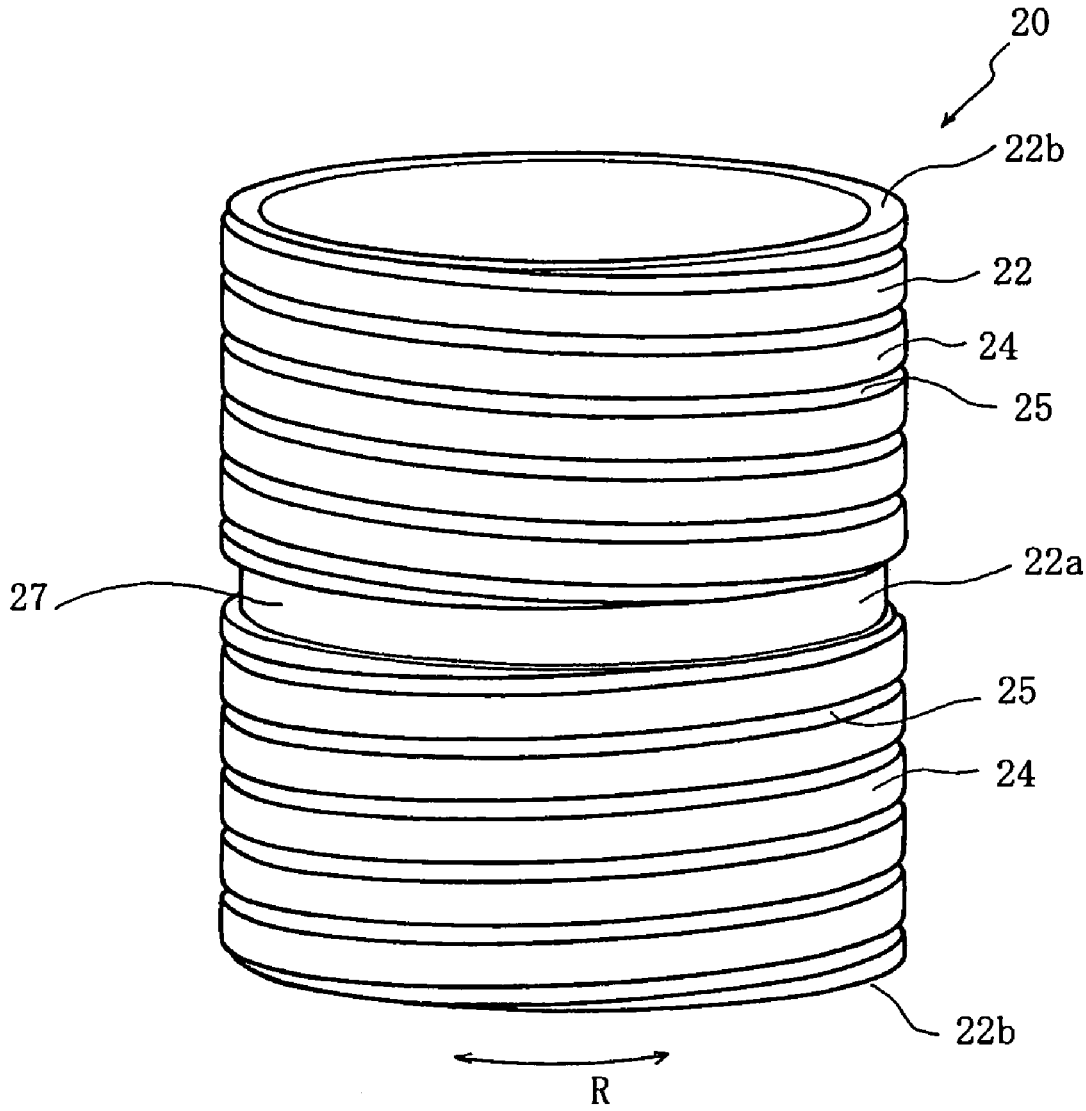
FIG. 20 is a perspective view of a cylinder liner according to the present invention.

FIG. 20 is a perspective view of a cylinder liner 20 in the second embodiment of the present invention. As shown in the figure, it is preferable to form a central gain 27 extending in a circumferential direction of the cylinder liner 20. The central gain 27 is formed on a centerline 22*a* of the cylinder liner 20 which crosses at a right angle with the central axis L thereof. It is preferable that the depth of the central gain 27 is the same as that of the groove 25. The provision of the central gain 27 makes it easy to measure or judge the manufacturing condition of the groove 25 including the depth of the groove 25. Moreover, it is easy to perform deburring, that is to eliminate burr which was formed when the grooves 25 were carved Here, the terms "upper" and "lower" used in the specification are only for the purpose of explanation based on the attached drawings. When the cylinder liner or cylinder block is placed in a different position, the upper and lower ends thereof change their positions corresponding to the axial direction of the cylinder liner or cylinder block.

EXAMPLE 1

Cast iron cylinders with inner diameter of 100 mm, outer diameter of 106 mm, and length in the axial direction of 120 mm were used as workpieces. The outer surfaces of the workpieces were carved by a carving tool having a nose angle of 35° and a corner radius of 0.4 mm, so that cylinder liners 20 having spiral grooves 25 having a depth of 0.7 mm were prepared. For comparison, cylinder liners 20 were formed with different cutting edge angles and different pitch sizes. Each of the cylinder liners 20 was used for a die-cast aluminum alloy cylinder block main body 30, so that a cylinder block 1 was formed. The contacting state at the interface between the cylinder liner 20 and the cylinder block main body 30, and the productivity of the cylinder block 1 were evaluated.

FIG. 21 and FIG. 22 show the test result. More precisely, FIG. 21 is a table for showing the relationship among the cutting edge angle, pitch of the spiral section, productivity of the cylinder liner 20, and the contacting state at the interface between the cylinder liner 20 and the cylinder block main body 30. FIGS. 22A to 22D are diagram for describing the cross-sections of the outer surface of the spiral parts 24 and the grooves 25 when the pitches are 1 mm, 2 mm, 3 mm, and 4 mm, respectively. The cutting edge angles α were set to be 50°, 40°, 30°, 20°, 10° in (a), (b), (c), (d) and (e) respectively, in each of the figures.

Figure 22A:
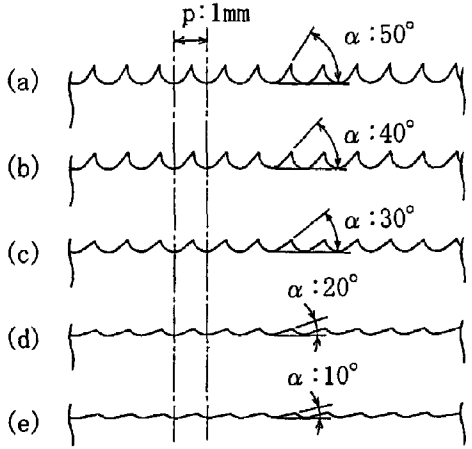
FIGS. 22A to 22D are diagrams for explaining formation of the spiral parts and the grooves in the cylinder liner tested in relation to FIG. 21.

FIGS. 21 and 22A show that no undercut was formed in the groove 25, and the spiral section 24 was not properly formed, when the pitch p was 1 mm and the cutting edge angle α was in the range of 5° to 55°. When the cylinder liner 20 is used for aluminum alloy casting, a cylinder block 1 was obtained only with a poor adhesion at the inter face B between the cylinder liner 20 and the cylinder block main body 30.

Figure 22B:
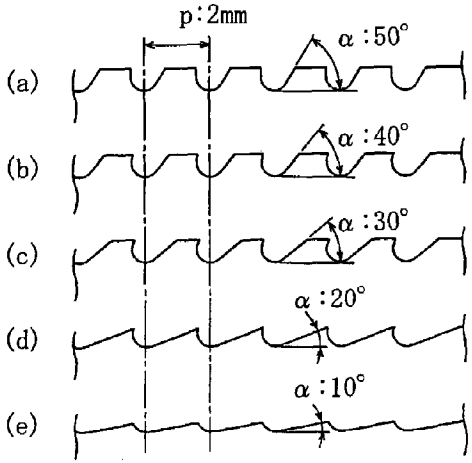

FIGS. 21 and 22B show that no undercut was formed in the groove 25 when the pitch p was 2 mm and the cutting edge angle α was 5°, 10° or 55°. Moreover, excessively small undercut was formed (formation of insufficient undercut) and the ratio of the outer surface of the spiral sections 24 was too large, based on the entire outer surface of the cylinder liner 20 (large outer surface ratio), when the pitch p was 2 mm and the cutting edge angle α was 15°, 40°, 45° or 50°. These cylinder liners 20 were not suitable for mass production, because the adhesion was poor at the interface between the cylinder liner 20 and the cylinder main block main body 30 and/or the productivity was not satisfactory. On the other hand, good interface adhesion and good productivity were obtained when the pitch p was 2 mm and the cutting edge angle α was in the range of 20° to 35°. From the test result, it can be seen that it is necessary to set the cutting edge angle α 14° or more, for forming a satisfactory undercut in the cylinder liner 20 with the pitch p of 2 mm.

Figure 22C:
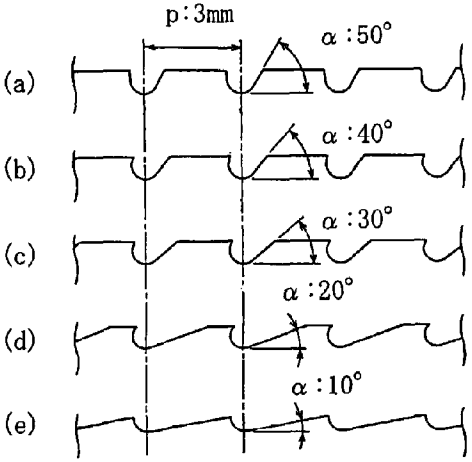

FIGS. 21 and 22C show that No undercut was formed in the groove 25 when the pitch p was 3 mm and the cutting edge angle α was 5°, or 55°. Moreover, excessively small undercut was formed (formation of insufficient undercut) and the ratio of the spiral sections 24 was too large based on the entire outer surface of the cylinder liner 20 (large outer surface ratio), when the pitch p was 3 mm and the cutting edge angle α was 10°, 15°, and 35° to 50°. These cylinder liners 20 were not suitable for mass production, because the adhesion was poor at the interface between the cylinder liner 20 and the cylinder main block main body 30, and/or the productivity was not satisfactory. On the other hand, good interface adhesion and good productivity were obtained when the pitch p was 3 mm and the cutting edge angle α was in the range of 20° to 30°. From the test result, it can be seen that it is necessary to set the cutting edge angle α 9° or more, for forming a satisfactory undercut in the cylinder liner 20 with the pitch p of 3 mm.

Figure 22D:
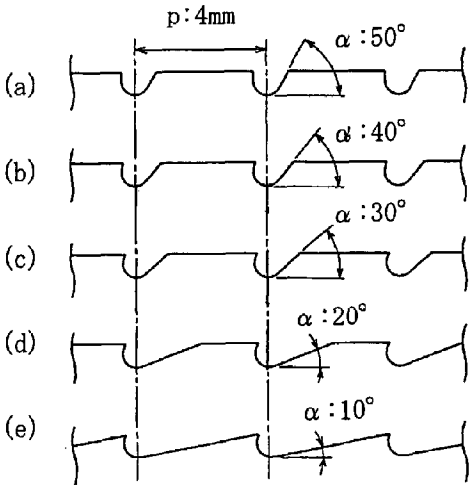

FIGS. 21 and 22D show that no undercut was formed in the groove 25 when the pitch p was 4 mm and the cutting edge angle α was 5° or 55°. Moreover, excessively small undercut was formed (formation of insufficient undercut) and the ratio of the spiral sections 24 was too large, based on the entire outer surface of the cylinder liner 20 (large outer surface ratio), when the pitch p was 4 mm and the cutting edge angle α was 10°, 15°, or 30° to 50°. These cylinder liners 20 were not suitable for mass production, because the adhesion was poor at the interface between the cylinder liner 20 and the cylinder main block main body 30, and/or the productivity was not satisfactory. On the other hand, good interface adhesion and good productivity were obtained when the pitch p was 4 mm and the cutting edge angle α was in the range of 20° to 25°. From the test result, it can be seen that it is necessary to set the cutting edge angle α 6° or more, for forming a satisfactory undercut in the cylinder liner 20 with the pitch p of 4 mm.

EXAMPLE 2

Cast iron cylinders with inner diameter of 100 mm, outer diameter of 106 mm, and length in the axial direction of 120 mm were used as workpieces. The outer surfaces of the workpieces were carved by a carving tool having a nose angle of 55° and a corner radius of 0.4 mm, so that cylinder liners 20 having spiral grooves 25 having a depth of 0.7 mm were prepared. For comparison, cylinder liners 20 were formed with different cutting edge angles and different pitch sizes. Each of the cylinder liners 20 was used for a die-cast aluminum alloy cylinder block main body 30, so that a cylinder block 1 was formed. The contacting state at the interface between the cylinder liner 20 and the cylinder block main body 30, and the productivity of the cylinder block were evaluated, depending on the cutting edge angle and pitch of the spiral section.

FIG. 23 shows the test result. More precisely, FIG. 23 is a table for showing the relationship among the cutting edge angle, pitch of the spiral section, productivity of the cylinder liner 20, and the contacting state at the interface between the cylinder liner 20 and the cylinder block main body 30.

FIG. 23 shows that no undercut was formed in the groove 25, and the spiral section 24 was not properly formed, when the pitch p was 1 mm and the cutting edge angle α was in the range of 5° to 55°. When the cylinder liner 20 was used for aluminum alloy casting, a cylinder block 1 was obtained only with a poor adhesion at the inter face B between the cylinder liner 20 and the cylinder block main body 30.

No undercut was formed in the groove 25 when the pitch p was 2 mm and the cutting edge angle α was 5°, 10° or 40° to 55°. Moreover, excessively small undercut was formed (formation of insufficient undercut), and the ratio of the outer surface of the spiral sections 24 was too large, based on the entire outer surface of the cylinder liner 20 (large outer surface ratio), when the pitch p was 2 mm and the cutting edge angle α was 15° to 25°. These cylinder liners 20 were not suitable for mass production, because the adhesion was poor at the interface between the cylinder liner 20 and the cylinder main block main body 30 and/or the productivity was not satisfactory. On the other hand, good interface adhesion and good productivity were obtained when the pitch p was 2 mm and the cutting edge angle α was in the range of 30° to 35°. From the test result, it can be seen that it is necessary to set the cutting edge angle α 14° or more, for forming a satisfactory undercut in the cylinder liner 20 with the pitch p of 2 mm.

No undercut was formed in the groove 25 when the pitch p was 3 mm and the cutting edge angle α was 5°, or 40° to 55°. Moreover, excessively small undercut was formed (formation of insufficient undercut) and the ratio of the outer surface of the spiral sections 24 was too large, based on the entire outer surface of the cylinder liner 20 (large outer surface ratio), when the pitch p was 3 mm and the cutting edge angle α was 10° to 25° or 35°. These cylinder liners 20 were not suitable for mass production, because the adhesion was poor at the interface between the cylinder liner 20 and the cylinder main block main body 30, and/or the productivity was not satisfactory. On the other hand, good interface adhesion and good productivity were obtained when the pitch p was 3 mm and the cutting edge angle α was 30°. From the test result, it can be seen that it is necessary to set the cutting edge angle α 9° or more, for forming a satisfactory undercut in the cylinder liner 20 with the pitch p of 3 mm.

No undercut was formed in the groove 25 when the pitch p was 4 mm and the cutting edge angle α was 5°, or 40° to 55°. Moreover, excessively small undercut was formed (formation of insufficient undercut) and the ratio of the outer surface of the spiral sections 24 was too large, based on the entire outer surface of the cylinder liner 20 (large outer surface ratio), when the pitch p was 4 mm and the cutting edge angle α was in the range of 10° to 35°. These cylinder liners 20 were not suitable for mass production, because the adhesion was poor at the interface between the cylinder liner 20 and the cylinder main block main body 30, and/or the productivity was not satisfactory. From the test result, it can be seen that it is necessary to set the cutting edge angle α 6° or more, for forming a satisfactory undercut in the cylinder liner 20 with the pitch p of 4 mm.

When the nose angle is made larger, the carving equipment can be used for a longer period of time. However, the design freedom as to the undercut shape is limited when the equipment with a large nose angle is used.

The terms "upper" and "lower" used herein are only for the purpose of explanation based on the attached drawings. When the cylinder liner or cylinder block is placed in a differently, the upper and lower ends thereof change their positions corresponding to the axial direction of the cylinder liner or cylinder block.

The present invention being thus described, it will be clearly understood that the same may be varied in many ways. Such variations are not to be regarded as a departure from the spirit and scope of the present invention, and all such modification as would be easily understood to one skilled in the art are intended to be included within the scope of the appended claims.

For example, it is possible partially omit the formation of the grooves 15, 25 in a predetermined range of area in the vicinity of the upper end of the cylinder liners 10 and 20. Therefore, the upper part of the cylinder liner can be formed thick and rigid. When such cylinder liners 10 and 20 are used to produce the cylinder block 1 of the present invention, the upper deck of the cylinder block is made strong. The strong upper end can absorb/receive the impact applied from a piston to the inner surface of the cylinder liner, and vibration of engine and noise thereof can be minimized.

What is claimed is:

1. A cast iron cylinder liner having a cylindrical shape to be used for casting an aluminum alloy cylinder block, comprising:

a plurality of grooves formed on an outer surface of the cylinder liner, each of the grooves extending in a circumferential direction of the cylinder liner in a ring shape, the grooves dividing the outer surface of the cylinder liner into a plurality of ring sections extending in a circumferential direction of the cylinder liner, each of the grooves being positioned between the ring sections by alternatively forming the grooves and the ring sections, outer surfaces of the ring sections having a uniform distance from the central axis of the cylinder liner over the entire area of the outer surfaces, the grooves being arranged symmetrically with respect to the center of the cylinder liner in an axial direction thereof, each of the grooves having a J-shaped longitudinal cross-section including a first inclination part and a groove bottom part, the first inclination part extending from the outer surface of one of the ring sections toward the center of the cylinder liner in an axial direction thereof, the groove bottom part having a longitudinal cross-section approximately in the form of a circular arc, the groove bottom part extending from the first inclination part in a direction away from the center of the cylinder liner in an axial direction thereof.

2. The cast iron cylinder liner as claimed in claim 1, wherein each of the grooves further comprises a second inclination part extending from the groove bottom part, the second inclination part opposing the first inclination part and extending in a direction away from the center of the cylinder liner in an axial direction thereof.

3. A cast iron cylinder liner having a cylindrical shape to be used for casting an aluminum alloy cylinder block, comprising:

at least two grooves formed on an outer surface of the cylinder liner, each of the grooves extending in the form of a spiral having a plurality of turns in a circumferential direction of the cylinder liner, the grooves dividing the outer surface of the cylinder liner into at least two spiral sections having a plurality of turns extending in a circumferential direction of the cylinder liner, each turn of the grooves being positioned between turns of the spiral sections, outer surfaces of the spiral sections having a uniform distance from the central axis of the cylinder liner over the entire area of the outer surfaces, the grooves being arranged symmetrically with respect to the center of the cylinder liner in an axial direction thereof, each of the grooves having a J-shaped longitudinal cross-section including a first inclination part and a groove bottom part, the first inclination part extending from the outer surface of one of the turns of the spiral sections toward the center of the cylinder liner in an axial direction thereof, the bottom part having a longitudinal cross-section approximately in the form of a circular arc, the groove bottom part extending from the first inclination part in a direction away from the center of the cylinder liner in an axial direction thereof.

4. The cast iron cylinder liner as claimed in claim 3, wherein each of the grooves further comprises a second inclination part extending from the groove bottom part, the second inclination part opposing the first inclination part and extending in a direction away from the center of the cylinder liner in an axial direction thereof.

5. The cylinder block as claimed in claim 3, further comprising a ring-shaped central gain on the outer surface of the cylinder liner, the central gain extending in a circumferential direction of the cylinder liner at the center of the cylinder liner in an axial direction thereof, the central gain at least partially overlapping with the groove formed closely to the center of the cylinder liner in an axial direction thereof.

6. A cylinder block comprising:

a cast iron cylinder liner having a cylindrical shape; and a cylinder block main body formed by casting aluminum alloy around the cylinder liner, comprising:

a plurality of grooves formed on an outer surface of the cylinder liner, each of the grooves extending in a circumferential direction of the cylinder liner in a ring shape, the grooves dividing the outer surface of the cylinder liner into a plurality of ring sections extending in a circumferential direction of the cylinder liner, each of the grooves being positioned between the ring sections by alternatively forming the grooves and the ring sections, outer surfaces of the ring sections having a uniform distance from the central axis of the cylinder liner over the entire area of the outer surfaces, the grooves being arranged symmetrically with respect to the center of the cylinder liner in an axial direction thereof, each of the grooves having a J-shaped longitudinal cross-section including a first inclination part and a groove bottom part, the first inclination part extending from the outer surface of one of the ring sections toward the center of the cylinder liner in an axial direction thereof, the groove bottom part having a longitudinal cross-section approximately in the form of a circular arc, the groove bottom part extending from the first inclination part in a direction away from the center of the cylinder liner in an axial direction thereof.

7. The cylinder block as claimed in claim 6, wherein each of the grooves in the cylinder liner further comprises a second inclination part extending from the groove bottom part, the second inclination part opposing the first inclination part and extending in a direction away from the center of the cylinder liner in an axial direction thereof.

8. A cylinder block comprising:

a cast iron cylinder liner having a cylindrical shape; and a cylinder block main body formed by casting aluminum alloy around the cylinder liner, comprising:

at least two grooves formed on an outer surface of the cylinder liner, each of the grooves extending in the form of a spiral having a plurality of turns in a circumferential direction of the cylinder liner, the grooves dividing the outer surface of the cylinder liner into at least two spiral sections having a plurality of turns extending in a circumferential direction of the cylinder liner, each turn of the grooves being positioned between turns of the spiral sections, outer surfaces of the spiral sections having a uniform distance from the central axis of the cylinder liner over the entire area of the outer surfaces, the grooves being arranged symmetrically with respect to the center of the cylinder liner in an axial direction thereof, each of the grooves having a J-shaped longitudinal cross-section including a first inclination part and a groove bottom part, the first inclination part extending from the outer surface of one of the turns of the spiral sections toward the center of the cylinder liner in an axial direction thereof, the bottom part having a longitudinal cross-section approximately in the form of a circular arc, the groove bottom part extending from the first inclination part in a direction away from the center of the cylinder liner in an axial direction thereof.

9. The cylinder block as claimed in claim 8, wherein each of the grooves in the cylinder liner further comprises a second inclination part extending from the groove bottom part, the second inclination part opposing the first inclination part and extending in a direction away from the center of the cylinder liner in an axial direction thereof.

10. The cylinder block as claimed in claim 8, further comprising a ring-shaped central gain on the outer surface of the cylinder liner, the central gain extending in a circumferential direction of the cylinder liner at the center of the cylinder liner in an axial direction thereof, the central gain at least partially overlapping with the groove formed closely to the center of the cylinder liner in an axial direction thereof.

* * * * *